US012042026B2

(12) United States Patent
Inukai et al.

(10) Patent No.: US 12,042,026 B2
(45) Date of Patent: Jul. 23, 2024

(54) SLIDE FASTENER

(71) Applicant: YKK Corporation, Tokyo (JP)

(72) Inventors: Takayuki Inukai, Toyama (JP); Toru Yabuya, Toyama (JP)

(73) Assignee: YKK CORPORATION, Toyama (JP)

( * ) Notice: Subject to any disclaimer, the term of this patent is extended or adjusted under 35 U.S.C. 154(b) by 123 days.

(21) Appl. No.: 17/801,782

(22) PCT Filed: Feb. 27, 2020

(86) PCT No.: PCT/JP2020/008163
§ 371 (c)(1),
(2) Date: Feb. 14, 2023

(87) PCT Pub. No.: WO2021/171518
PCT Pub. Date: Sep. 2, 2021

(65) Prior Publication Data

US 2023/0180897 A1 Jun. 15, 2023

(51) Int. Cl.
*A44B 19/26* (2006.01)

(52) U.S. Cl.
CPC ..... *A44B 19/265* (2013.01)

(58) Field of Classification Search
CPC .... A44B 19/265; A44B 19/26; Y10T 24/2582
See application file for complete search history.

(56) References Cited

U.S. PATENT DOCUMENTS

| | | | | |
|---|---|---|---|---|
| 4,590,648 A | | 5/1986 | Yoshida et al. | |
| D291,546 S | * | 8/1987 | Oda | D11/221 |
| 5,497,535 A | * | 3/1996 | Kloor | A44B 19/265 24/426 |
| D403,987 S | * | 1/1999 | Minato | D11/221 |

(Continued)

FOREIGN PATENT DOCUMENTS

| | | |
|---|---|---|
| JP | 51-053765 Y | 12/1976 |
| JP | 59-174016 U1 | 11/1984 |

(Continued)

OTHER PUBLICATIONS

International Search Report mailed on May 19, 2020, from International Application No. PCT/JP2020/008163, 6 pages.

(Continued)

*Primary Examiner* — Robert Sandy
*Assistant Examiner* — Louis A Mercado
(74) *Attorney, Agent, or Firm* — Procopio, Cory, Hargreaves & Savitch LLP

(57) ABSTRACT

A slide fastener includes a pair of left and right fastener stringers each having an element row at each of opposing edge portions of left and right fastener tapes, and a slider configured to engage the element rows by moving forward between the pair of left and right fastener stringers and to disengage the element rows by moving backward. The slider includes an upper wing plate, a lower wing plate , a guide pillar for connecting the upper wing plate to the lower wing plate, a Y-shaped element path defined between the upper wing plate and the lower wing plate, left and right shoulder openings that are open forward the element path, and a rear opening that is open backward the element path.

11 Claims, 13 Drawing Sheets

(56) References Cited

U.S. PATENT DOCUMENTS

| | | | | |
|---|---|---|---|---|
| 8,752,253 | B2 * | 6/2014 | Sato | A44B 19/28 24/429 |
| 8,826,500 | B2 * | 9/2014 | Sato | A44B 19/303 24/429 |
| 9,138,033 | B2 * | 9/2015 | Kojima | A44B 19/32 |
| 9,434,113 | B2 * | 9/2016 | Yamakita | A44B 19/02 |
| D812,520 | S * | 3/2018 | Di Girolami | D11/221 |
| 2005/0132541 | A1 * | 6/2005 | Yang | A44B 19/26 24/415 |
| 2010/0154179 | A1 | 6/2010 | Blackford et al. | |
| 2011/0296654 | A1 | 12/2011 | Sato | |
| 2012/0291236 | A1 * | 11/2012 | Lin | A44B 19/26 24/429 |
| 2013/0139364 | A1 | 6/2013 | Sato | |
| 2013/0219676 | A1 * | 8/2013 | Takahashi | A44B 19/02 24/403 |
| 2017/0280834 | A1 | 10/2017 | Inukai | |
| 2018/0110301 | A1 | 4/2018 | Lee | |

FOREIGN PATENT DOCUMENTS

| | | | | |
|---|---|---|---|---|
| JP | 2005160785 | A | 6/2005 | |
| JP | 2012513293 | A | 6/2012 | |
| JP | 6225266 | B2 | 11/2017 | |
| JP | 2018514314 | A | 6/2018 | |
| WO | WO-2010070743 | A1 * | 6/2010 | A44B 19/26 |
| WO | 2010113275 | A1 | 10/2010 | |
| WO | 2010113281 | A1 | 10/2010 | |
| WO | 2012020489 | A1 | 2/2012 | |

OTHER PUBLICATIONS

International Preliminary Report on Patentability mailed on Sep. 9, 2022, from International Application No. PCT/JP2020/008163, 7 pages.

* cited by examiner

[FIG. 1]
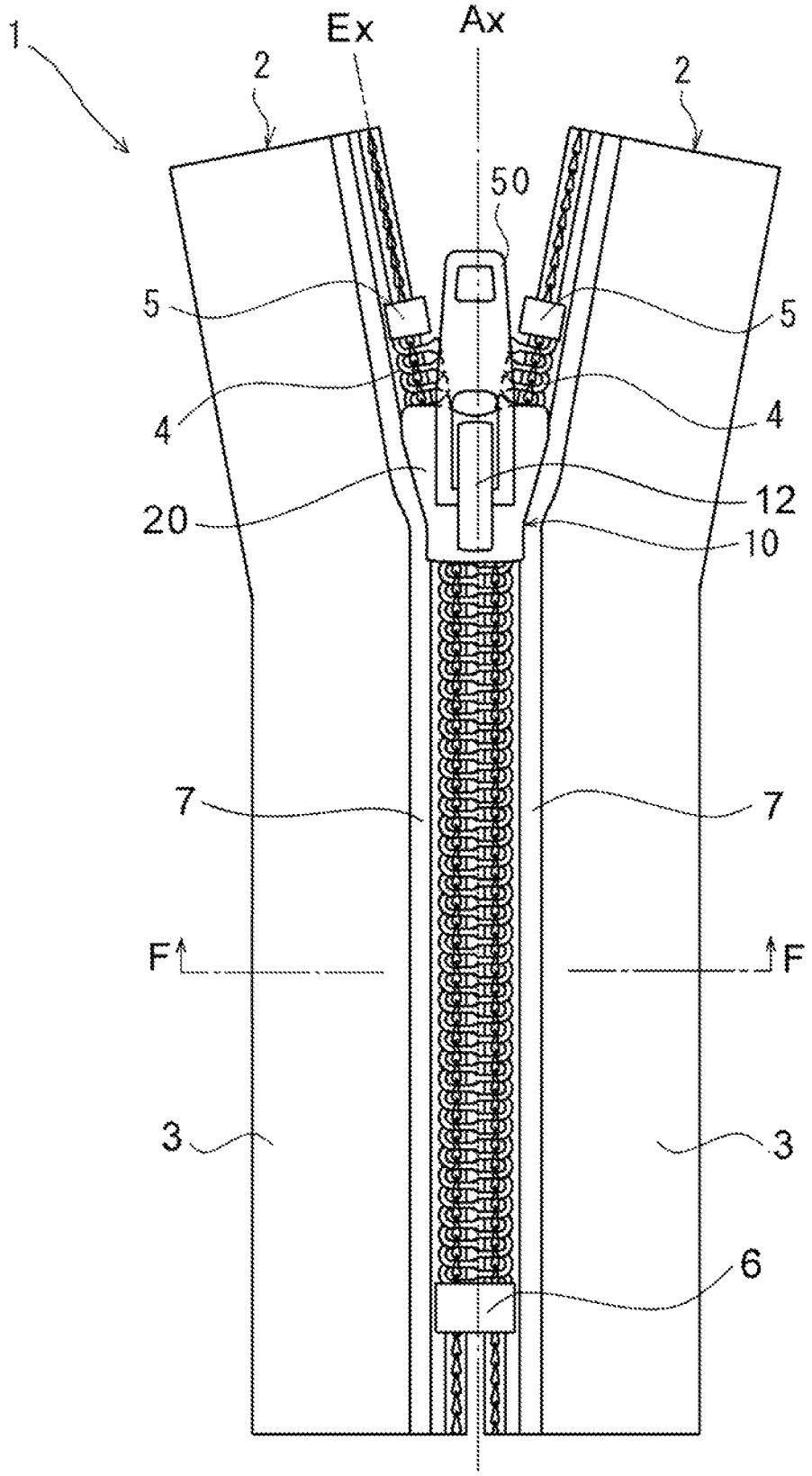

[FIG. 2]
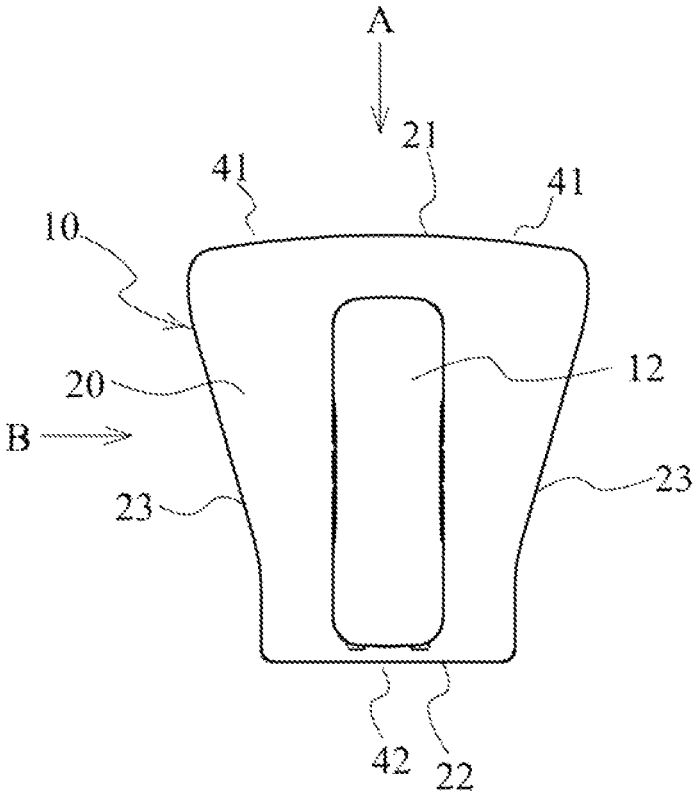

[FIG. 3]
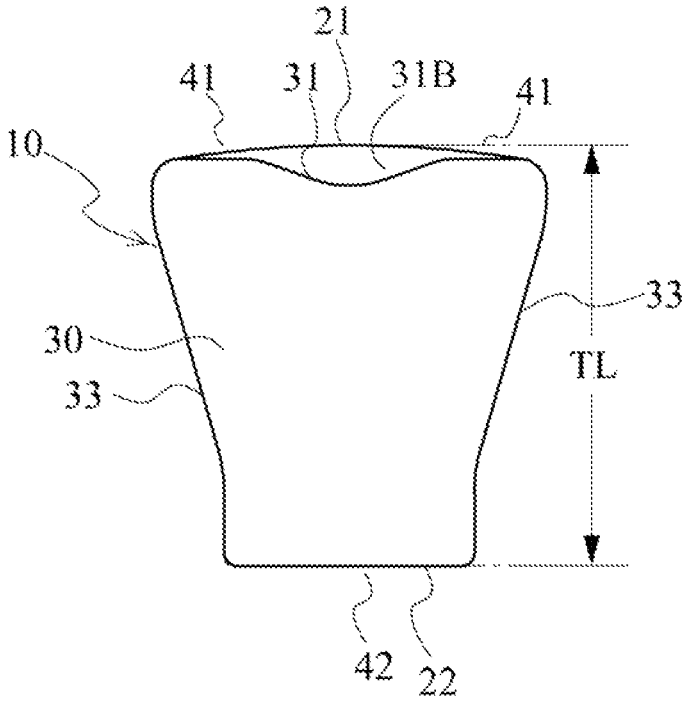

[FIG. 4]
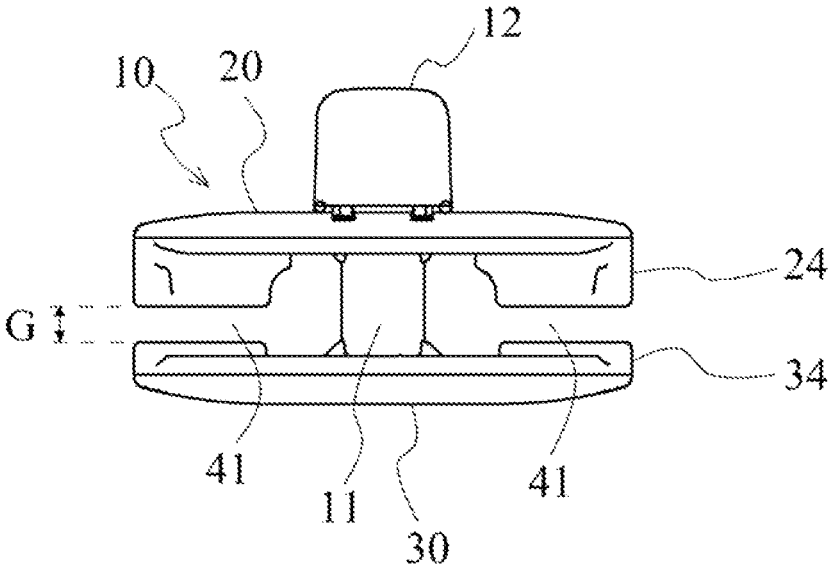

[FIG. 5]
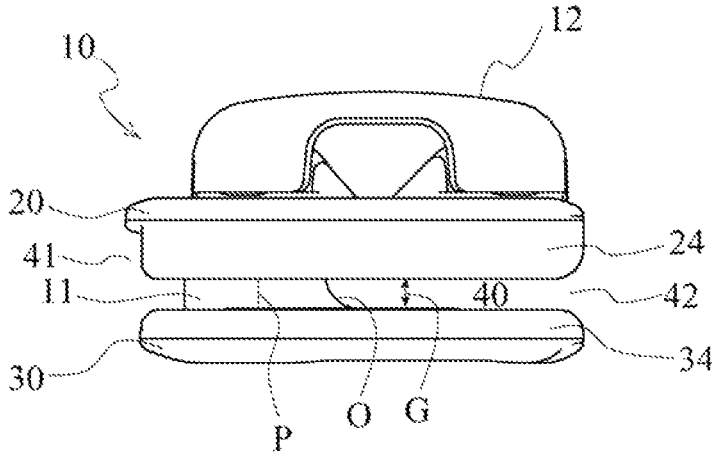

[FIG. 6]
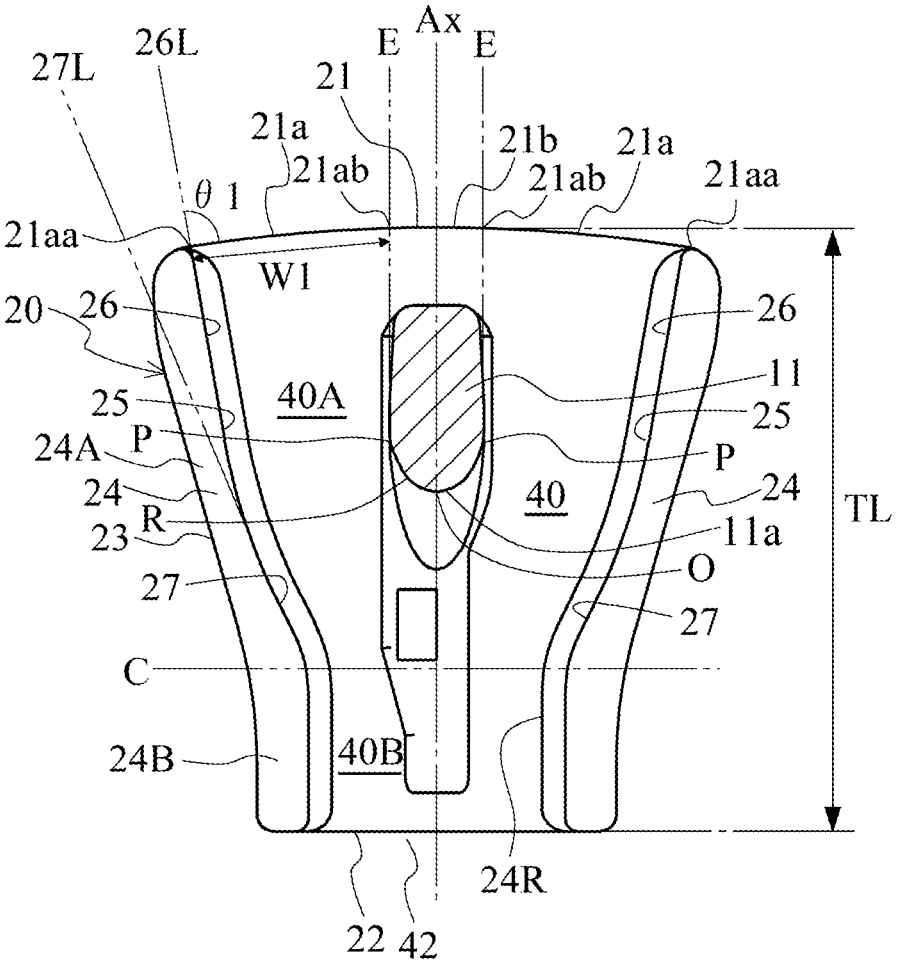

[FIG. 7]
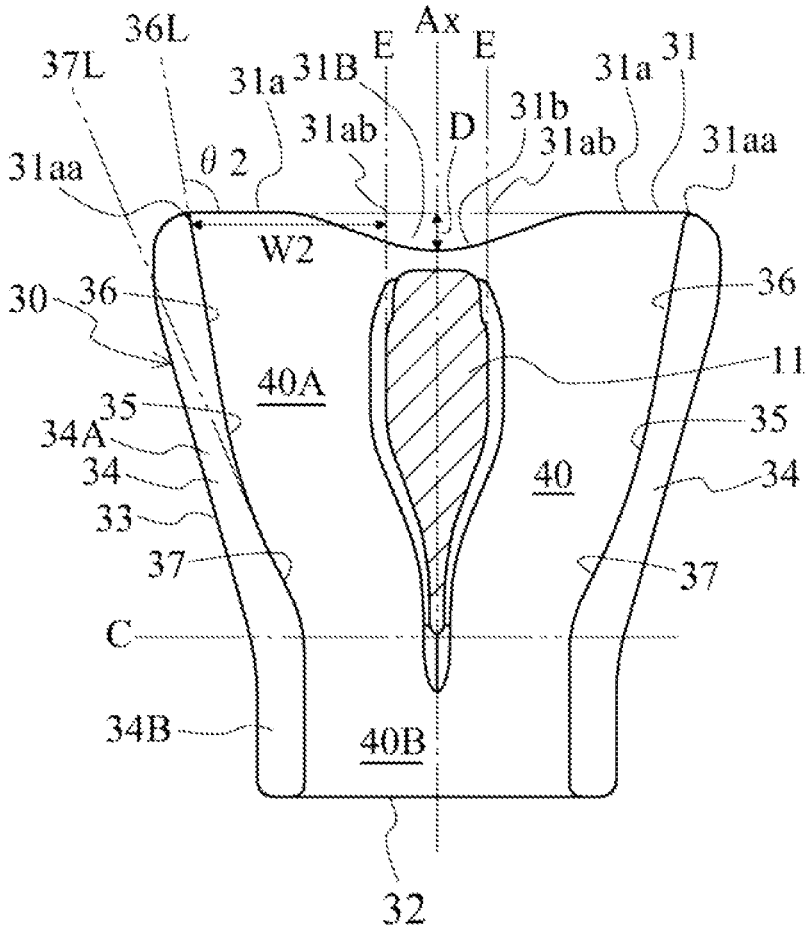

[FIG. 8]
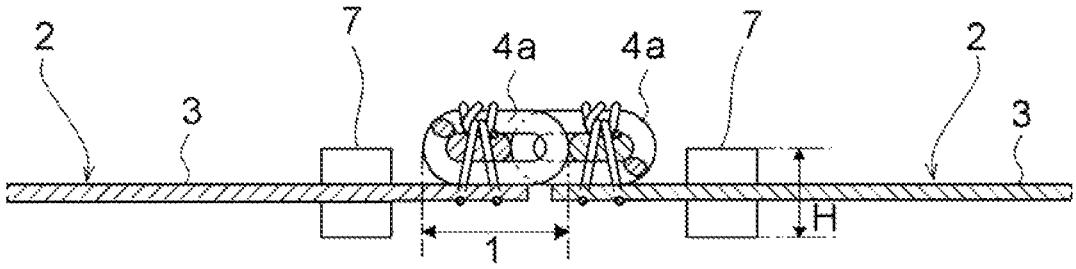

[FIG. 9]
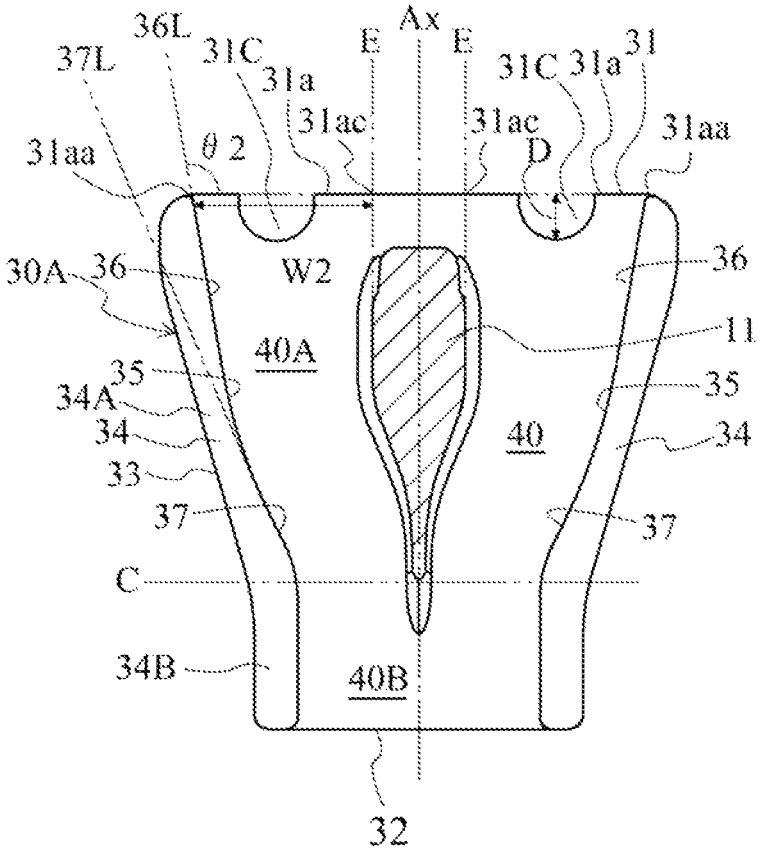

[FIG.10]
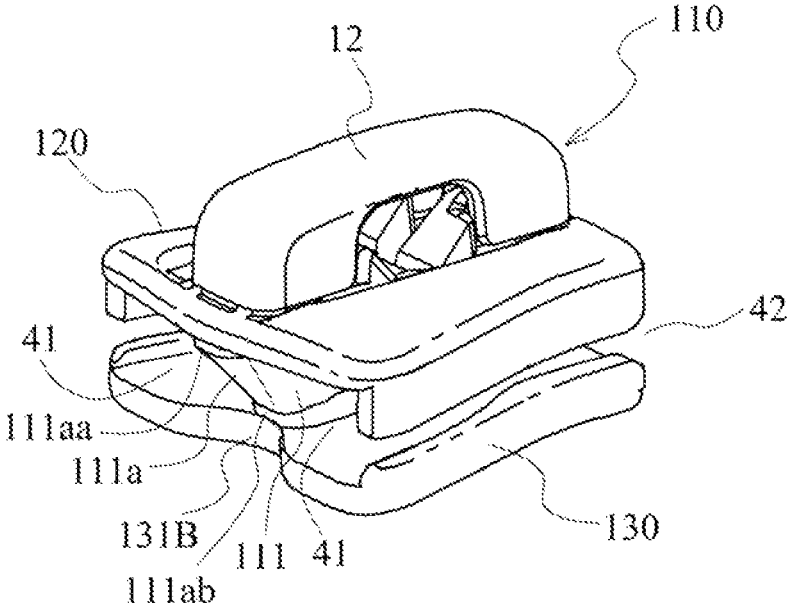

[FIG.11]
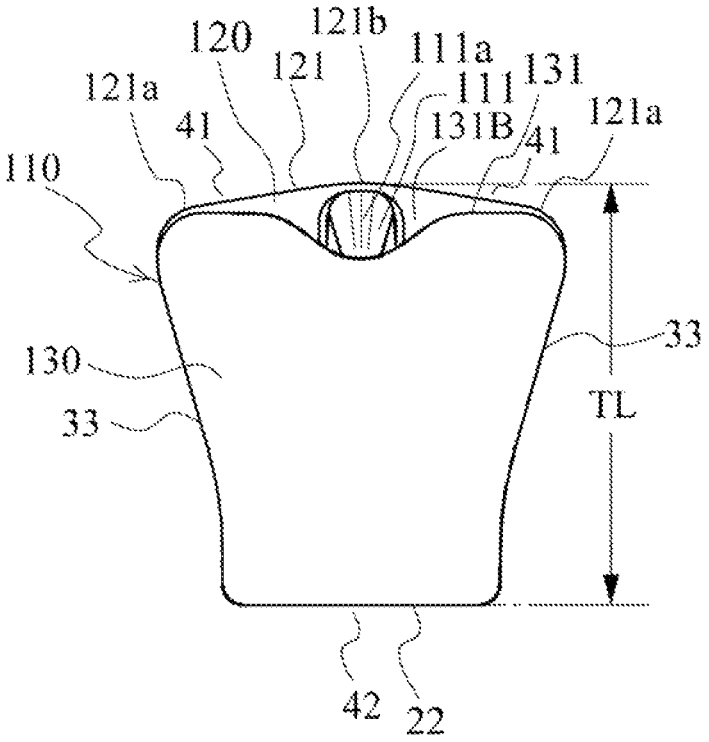

[FIG.12]
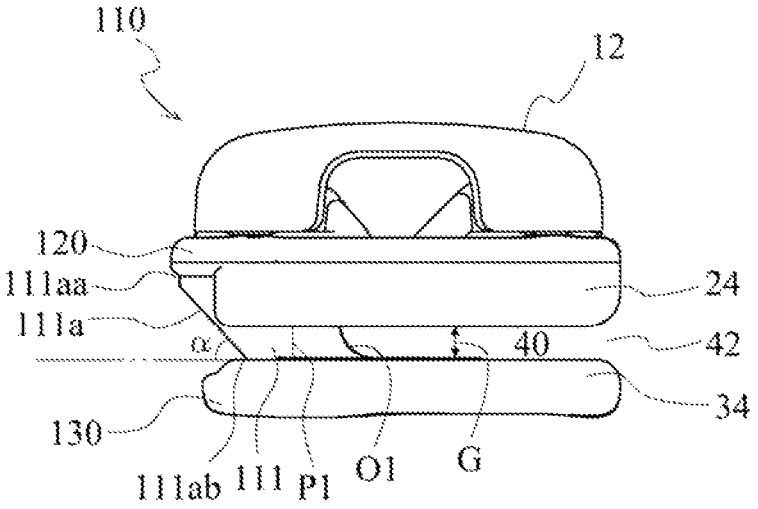

[FIG. 13]
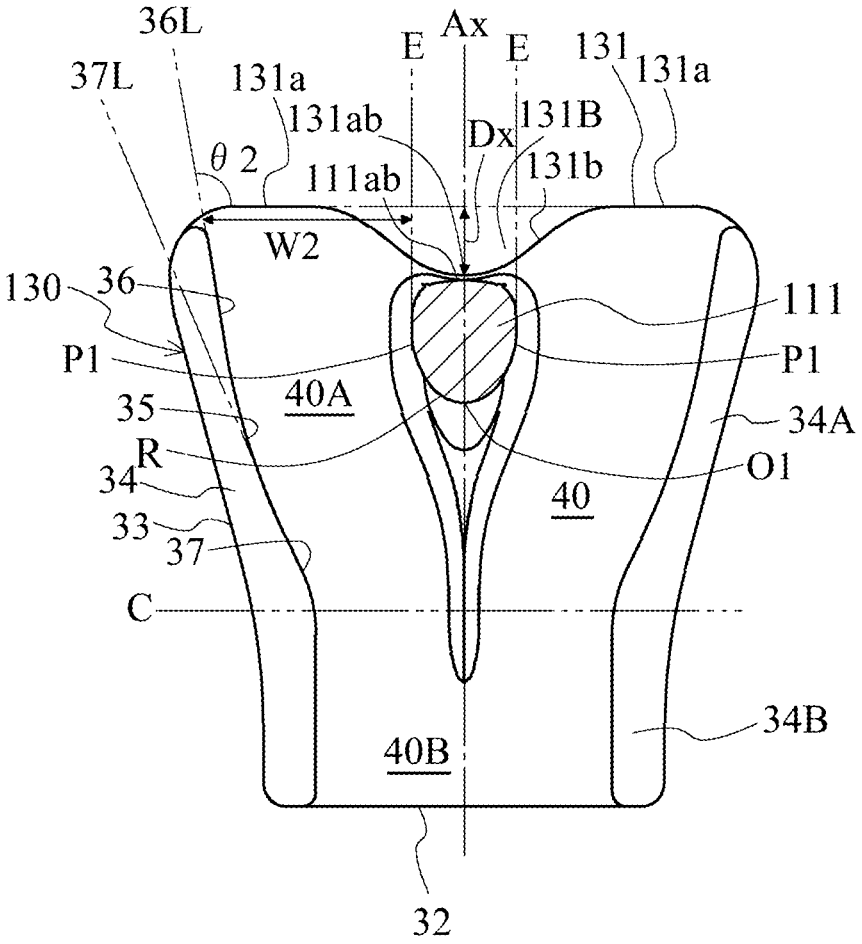

SLIDE FASTENER

CROSS-REFERENCE TO RELATED APPLICATIONS

This application is a US national stage application of International Application PCT/JP2020/008163, filed Feb. 27, 2020, the contents of which are incorporated by reference.

FIELD OF THE INVENTION

The present invention relates to a slide fastener, particularly to a slide fastener including a slider.

BACKGROUND OF THE INVENTION

Slide fasteners are widely used in clothes, bags, tents, sleeping bags and the like. The slide fastener opens and closes between element rows provided at opposing edges of a pair of left and right fastener stringers by moving a slider in one direction or the other. That is, when the slider is moved to two shoulder openings (front openings) side, the left and right element rows are engaged with each other to close a space between the left and right fastener stringers, and when the slider is moved to the rear opening side, the left and right element rows are disengaged with each other to open the left and right fastener strings. In such a slide fastener, for example, fabrics such as clothes may be bitten between the element row entering the slider from the left or right shoulder opening and the slider, during slider movement. In particular, for a type of slider in which the front end on the shoulder opening side protrudes forward in an inverted U-shape or an inverted V-shape, each opening end of the left and right shoulder openings of the slider forms an acute angle with the longitudinal direction of each of the element rows, which is slightly diagonal leftward or rightward just before entering both shoulder openings. Therefore, a fabric is likely bitten when the left and right fastener stringers are closed.

Japanese Patent Application Publication No. 2005-160785 A (Patent Literature 1) proposes a slider for the purpose of reducing the biting of a fabric as described above. The slider of Patent Literature 1 expands two shoulder opening side portions of the slider in a V shape, whereby each of the open end sides of the left and right shoulder openings can form an obtuse angle with the longitudinal direction of each element row, and a fabric can be released from an intermediate bottom of the V-shaped part. Thereby, a percentage of biting generated in a fabric can be lowered. However, in general, the biting prevention effect is not sufficient because the expanded V-shaped part easily accepts a fabric, increasing a risk of a fabric biting occurrence.

Further, Japanese Patent No. 6225266 B (Patent Literature 2) proposes a technique for reducing the biting of a fabric by a cover subsequently attached to the slider. However, it is necessary to purchase a separate part separately from the slider, which increases the cost, and the shoulder opening sides of the slider to which the cover is attached expand, leading to easy acceptance of a fabric.

CITATION LIST

Patent Literatures

[Patent Literature 1] Japanese Patent Application Publication No. 2005-160785 A

[Patent Literature 2] Japanese Patent No. 6225266 B

SUMMARY OF THE INVENTION

Technical Problem

Therefore, an object of the present invention is to provide a slide fastener that can reduce the biting of a fabric by the slider itself without unnecessarily expanding the size of the slider.

Solution to Problem

To solve the above problems, the present invention provides a pair of left and right fastener stringers each having an element row at each of opposing edge portions of left and right fastener tapes; and a slider, the slider being configured to engage the element rows by moving forward between the pair of left and right fastener stringers and to disengage the element rows by moving backward, wherein the slider comprises: an upper wing plate; a lower wing plate; a guide pillar for connecting the upper wing plate to the lower wing plate; a Y-shaped element path defined between the upper wing plate and the lower wing plate; left and right shoulder openings that open forward the element path; and a rear opening that opens backward the element path; wherein each of the upper wing plate and the lower wing plate has left and right front end sides that form opening ends of the left and right shoulder openings; wherein at least one of the upper wing plate and the lower wing plate has one or more concave portions recessed backward from the left and right front end sides; and wherein a depth of each of the concave portions recessed backward from the left and right front end sides is larger than zero, and less than or equal to a distance to each of end points of R of the guide pillar.

The guide pillar of the slider has a shape in which the left-right width gradually decreases with the same R on the left and right from the vicinity of the center in the front-rear direction toward the rear (rear opening side) as viewed in a plane. Referring now to FIG. 6, the left and right R starts from a rear end O in a horizontal cross section of the guide pillar 11 and ends at left and right points P, while the left and right width gradually expands toward the front (the upper on the paper surface of FIG. 6). In this specification, each point P is defined as the "end point of R" of the guide pillar. The present inventors have found that the slider itself can reduce the biting of a fabric without unnecessarily expanding the size of the slider, by setting the depth of each concave portion from the left and right front end sides toward the rear to be larger than zero and less than or equal to the distance to each end point of R of the guide pillar. In the present invention, it is preferable that the depth of each concave portion recessed backward from the left and right front end sides is greater than 0% and less than or equal to 20.0% of the front-rear length of the slider.

In an embodiment according to the present invention, the slide fastener has coiled element rows on only one of front and back surfaces of the fastener tapes, and in a reverse use for using the side having the element row as a back surface, the depth of each of the concave portions recessed backward from the left and right front end sides is larger than 0% and less than or equal to 35.0% of a length of the slider in a front-rear direction. This is a finding obtained from the results of Experimental Example 2 as described later.

In an embodiment according to the present invention, a front end portion of the guide pillar is inclined so as to gradually project forward from the lower wing plate to the upper wing plate. That is, referring to FIG. 12, the front end portion 111*a* of the guide pillar 111 is inclined at an angle α with respect to the horizontal. Such an inclination of the front end portion of the guide pillar can suppress the movement of a fabric, which may be bitten by the slider, in the up-down direction and the left-right direction of the slider, so that the biting is less likely to occur.

In an embodiment according to the invention, the concave portion(s) is/are provided between the left and right front end sides. In this case, for example, one concave portion is provided between the left front end side and the right front end side. In another embodiment according to the invention, the concave portion(s) is/are provided at each of the left and right front end sides. In this case, for example, one concave portion is provided at each of the left and right front end sides.

In an embodiment according to the present invention, a shoulder opening width of each of the left and right shoulder openings in a direction along the left and right front end sides is larger than 1 time and less than or equal to 1.1 times the width of one element, along a left-right direction, of the element row. In this embodiment, the shoulder opening width W of each of the left and right shoulder openings of the slider is set to be $1<W\leq1.1$, with respect to 1 width, along the left-right direction, of one element (or one element unit). Each shoulder opening width is a distance between an outer end and an inner end (when the inner end actually exists) of the front end side in a direction along the left or right front end side of the upper wing plate and the lower wing plate, or a distance between an outer end and a virtual inner end (a virtual inner end that has not existed by providing a concave portion; that would exist if the concave portion were not provided; and that is the virtual inner end when the corresponding front end side is extended in the region of the concave portion) of the front end side in the direction along the front end side. In addition, the inner end or the virtual inner end is on a virtual line that is defined by extending forward the left or right end of the guide pillar in parallel with the left-right intermediate axis (see reference numeral Ax in FIG. 6, etc.) of the slider. By setting each shoulder opening width as described above, a fabric can be released from the concave portion(s) provided so as to be recessed backward from the left and right front end sides without unnecessarily expanding the left and right width on the front end side of the upper and lower wing plates.

In an embodiment according to the present invention, at least one of the upper wing plate and the lower wing plate comprises left and right flanges that define left and right outer side surfaces of the element path as inward surfaces, wherein each of the inward surfaces of the left and right flanges comprises a first inward surface that intersects with an outer end of each of the left and right front end sides, and wherein the first inward surface of each of the left and right flanges and each of the left and right front end sides form an obtuse angle. The first inward surface each of the left and right flanges of the upper and lower wing plates, which the first inward surface intersects with the outer end of each of the left and right front end sides, determines an inclination, with respect to the left-right intermediate axis Ax (see FIG. 1) of the slider, of a longitudinal axis Ex (see FIG. 1) of each of the left and right element rows immediately before entering the left and right shoulder openings. In other words, the longitudinal axis Ex of each element row immediately before entering the left and right shoulder openings is substantially parallel to the first inward surface, and an angle formed between the longitudinal axis Ex or the first inward surface and the left or right front end side is greater than 90°. By thus setting the angle between the left or right front end side and the corresponding first inward surface to an obtuse angle, the biting of a fabric can be reduced.

In an embodiment according to the present invention, the element path comprises: branched portions defined on left and right sides of the guide pillar, the branched portions being open at the left and right shoulder openings; and a confluent portion extending backward from the branched portions and being open at the rear opening, wherein the left and right flanges include branched flange portions corresponding to the branched portions, wherein each of the branched flange portions includes the first inward surface; and a second inward surface extending backward from the first inward surface, the second inward surface being angled with respect to the first inward surface, and wherein an inclination angle with respect to the left-right intermediate axis of the slider is larger for the second inward surface than for the first inward surface. In this case, a distance between the left and right outer sides of the Y-shaped element path in the branched portions can be narrowed toward the confluence portion, in a way of two-step inclination angles from the front first inward surface to the rear second inward surface. As a result, when engaging the element rows of the left and right fastener stringers, the element rows can be more aligned from the first inward surfaces to the second inward surfaces, so that the element rows can be more smoothly engaged.

In an embodiment according to the present invention, a front end of the guide pillar is located backward from the left and right front end sides and the concave portions. This facilitates the releasing of a fabric from the concave portions before the fabric to likely be bitten enters the space between the element row and the guide pillar.

In an embodiment according to the present invention, the depth of each of the concave portions depressed backward from the left and right lower front end sides is larger than 0% and less than or equal to 20% of a length of the slider in a front-rear direction. This can minimize damage, caused by the concave portions, to a fabric that is to be released by the concave portions.

In an embodiment according to the present invention, the slider includes left and right gaps between the upper wing plate and the lower wing plate for passing the left and right fastener tapes corresponding to the element rows in the element path, wherein each of the left and right fastener tapes includes a thick portion along a longitudinal direction, the thick portion restricting the entry of the left and right fastener tapes into the element path through the left and right gaps, and wherein a length of each of the thick portions in an up-down direction is larger than a distance of each of the gaps in the up-down direction. In this embodiment, the left and right fastener tape portions connected to the element rows in the element path of the slider through the gaps between the upper and lower wing plates are restricted from entering the element path through the gaps due to the thick portions.

Advantageous Effects of Invention

In the slide fastener according to the present invention, by setting the depth of each concave portion from the left and right front end sides toward the rear to be larger than zero and less than or equal to the distance to each end point of R of the guide pillar, a fabric to be bitten can be released from the concave portion without unnecessarily expanding the left-right width of the upper and lower wing plates on the front end side.

BRIEF DESCRIPTION OF THE DRAWINGS

FIG. 1 is a plane view of a slide fastener according to an embodiment of the present invention;

FIG. 2 is a plane view of a slider;

FIG. 3 is a bottom view of a slider;

FIG. 4 is a front view of the slider as seen from the arrow A in FIG. 2;

FIG. 5 is a side view of the slider as seen from the arrow B in FIG. 2;

FIG. 6 is a partial cross-sectional plane view showing a lower surface of an upper wing plate facing a lower wing plate;

FIG. 7 is a partial cross-sectional plane view showing an upper surface of a lower wing plate facing an upper wing plate;

FIG. 8 is a cross-sectional view taken along the line F-F in FIG. 1;

FIG. 9 is a partial cross-sectional plane view, similar to FIG. 7, showing a second embodiment of a lower wing plate;

FIG. 10 is a perspective view showing a slider according to a third embodiment;

FIG. 11 is a bottom view of the slider in FIG. 10;

FIG. 12 is a side view of the slider in FIG. 10; and

FIG. 13 is a partial cross-sectional plane view, similar to FIG. 7, showing an upper surface of a lower wing plate.

DETAILED DESCRIPTION OF THE INVENTION

Hereinafter, embodiments of a slide fastener according to the present invention will be described with reference to the drawings, but the present invention is not limited to such embodiments. FIG. 1 is a plane view of a slide fastener 1 according to an embodiment of the present invention. The slide fastener 1 comprises: a pair of left and right fastener stringers 2, 2; and a slider 10 according to a first embodiment, which is moved by a user to open and close the left and right fastener stringers 2, 2. The left and right fastener stringers 2, 2 include: left and right fastener tapes 3, 3 in a long strip-shaped; and element rows 4 provided along opposing edge portions of the fastener tapes 3, respectively. In the present embodiment, each fastener tape 3 is formed by weaving weft and warp, but the present invention is not limited to thereto. Each fastener tape 3 may be a knitted fabric or a mixture of a woven fabric and a knitted fabric. In the present embodiment, each element row 4 is a coil-shaped element row 4 in which a monofilament is spirally wound, and is attached to the opposing edge portion of each fastener tape 3 with a sewing thread. One coil of each element row 4 is one (or one unit) element 4*a* (see FIG. 8). It should be noted that each element row 4 may be composed of a number of metal or resin elements. By moving the slider 10 forward (upward on the paper surface of FIG. 1), the left and right element rows 4 are engaged with each other to close the space between the left and right fastener stringers 2, 2. Further, by moving the slider 10 backward (downward on the paper surface of FIG. 1), the left and right element rows 4 are disengaged with each other to open the space between the left and right fastener stringers 2, 2. As used herein, the longitudinal direction of the slide fastener 1 is referred to as a front-rear direction, and the slider 10 moves in the front-rear direction. In FIG. 1, reference numeral 5 is a front stopper. The front stopper 5 restrict the forward movement of the slider 10. The reference numeral 6 in FIG. 1 is a rear stopper. The rear stopper 6 restricts the backward movement of the slider 10. The slide fastener 1 may be provided with an openable tool instead of the rear stoppers 6. As used herein, the thickness direction of each fastener tape 3 is referred to as an up-down direction. Further, as used herein, the left-right direction is a direction orthogonal to the front-rear direction and the up-down direction.

FIG. 2 is a plane view of the slider 10. FIG. 3 is a bottom view of the slider 10. FIG. 4 is a front view of the slider 10 as seen from the arrow A in FIG. 2. FIG. 5 is a side view of the slider 10 as seen from the arrow B in FIG. 2. The slider 10 comprises: an upper wing plate 20; a lower wing plate 30 arranged below the upper wing plate 20 so as to face the upper wing plate 20; and a guide pillar 11 connecting the upper wing plate 20 to the lower wing plate 30. The upper surface of the upper wing plate 20 is provided with a semi-annular pull connecting pillar 12. To the pull connecting pillar 12, a pull 50 is connected as shown in FIG. 1. Although in the slide fastener 1 shown in FIG. 1, the upper wing plate 20 of the slider 10 is arranged at the upper side and the lower wing plate 30 is arranged at the lower side, the upper wing plate 20 of the slider 10 may be arranged at the lower side and the lower wing plate 30 may be arranged at the upper side, for so-called reverse use of the slider 10.

FIG. 6 is a partial cross-sectional plane view showing a lower surface of the upper wing plate 20 facing the lower wing plate 30. FIG. 7 is a partial cross-sectional plane view showing an upper surface of the lower wing plate 30 facing the upper wing plate 20. In each of FIGS. 6 and 7, the guide pillar 11 is shown in a cross section. A Y-shaped element path 40 is defined between the upper wing plate 20 and the lower wing plate 30. The slider 10 includes left and right shoulder openings 41, 41 that are open forward the element path 40, and a rear opening 42 that is open backward the element path 40. The element path 40 is divided into branched portions 40A defined on the left and right sides of the guide pillar 11 and open at the left and right shoulder openings 41, 41, and a confluent portion 40B extending backward (downward on each paper surface of FIGS. 6 and 7) from the branched portions 40A and open at the rear opening 42. The guide pillar 11 defines the inner sides of the branched portions 40A in the left-right direction. In FIGS. 6 and 7, the boundary between the branched portions 40A and the confluent portion 40B is shown by a two-dot chain line C for convenience.

The slider 10 is substantially symmetrical in the left-right direction except for details relating to a locking mechanism, a description of which is omitted. Therefore, in the following descriptions of the slider 10, the left and right are not particularly distinguished. For example, the left and right on the lower surface of the upper wing plate 20 in FIG. 6 and the left and right on the upper surface of the lower wing plate 30 in FIG. 7 are opposite to each other. However, it is to understand that in the following descriptions in relation to FIGS. 6 and 7, the left and right are based on each paper surface of FIGS. 6 and 7. Further, the description of one of the left and right can apply to the other of the left and right, and a reference numeral in the drawings may be added to only one of the left and right and the other may be omitted. With reference to FIG. 6, etc., the upper wing plate 20 has an upper front end 21, an upper rear end 22, and upper left and right side ends 23. The upper front end 21 is divided into left and right upper front end sides 21*a* forming open ends of the left and right shoulder openings 41 and an intermediate side 21*b* between the left and right upper front end sides 21*a*. The boundary points (21*ab*) between the left and right upper front end sides 21*a* and the intermediate side 21*b*, namely, inner ends 21*ab* of the left and right upper front end sides 21*a* are located on virtual lines E, which are respectively extended from left and right ends (end points P of R) of the guide pillar 11 forward in parallel with the left-right intermediate axis Ax of the slider 10. The length of each of the left and right upper front end sides 21*a* is a distance between the outer end 21*aa*, in the left-right direction, of each upper front end side 21*a* and the inner end 21*ab* of each upper front end side 21*a*. The length of each upper front end side 21*a* is a shoulder opening width W1, in a direction along each of the left and right upper front end sides 21*a*, of each of the left and right shoulder openings 41 in the upper wing plate 20. Assuming that the length, along the left-right direction, of one element 4*a* (see FIG. 8) forming the element row 4 is 1, the shoulder width W1 in the upper wing plate 20 is set to be larger than 1 time and less than or equal to 1.1 times ($1<W1\leq1.1$).

With reference to FIG. 6, the guide pillar 11 has a rear facing surface 11*a* facing the rear opening 42 side. The rear facing surface 11*a* is a surface whose left and right width gradually decreases from the left and right points P to the rear opening 42 side with the same radius of curvature R on the left and right. In other words, in the horizontal cross section of the guide pillar 11 shown in FIG. 6, each R on the left and right starts at the rear end O and ends at each of the left and right points P, while the left or right width of the pillar 11 gradually expands frontward (upper on the paper surface of FIG. 6). Hereinafter, in this specification, the point(s) P (or P1 as described later) is/are referred to as "end point(s) of R". The end points P of R are at the same position in the height (up-down) direction of the guide pillar 11 as viewed in a plane. In the slider 10, the end points P of R coincide with the left and right ends of the guide pillar 11.

With reference to FIG. 7, etc., the lower wing plate 30 has: a lower front end 31; a lower rear end 32; and lower left and right side ends 33. The lower front end 31 is divided into left and right lower front end sides 31*a* forming a part of the opening ends of the left and right shoulder openings 41, and a concave side 31*b* recessed backward between the left and right lower front end sides 31*a*. Each of the left and right lower front end sides 31*a* is substantially perpendicular to the left-right intermediate axis Ax of the slider10. In the left-right direction, the length of each of the left and right lower front end sides 31*a* is about ½ of the length of the concave side 31*b* along the left-right direction. The concave side 31*b* is recessed in a dish shape from the actual inner ends of the left and right lower front end sides 31*a*. In the lower wing plate 30, left and right side portions of the concave side 31*b* also form a part of the opening ends of the left and right shoulder openings 41. The concave side 31*b* defines a concave portion 31B that is recessed backward from and between the left and right lower front end sides 31*a*. A shoulder opening width W2 in a direction along each of the left and right lower front end sides 31*a* of the lower wing plate 30 is a length between an outer end 31*aa*, in the left and right direction, of each lower front end side 31*a* and a virtual inner end 31*ab* of each lower front end side 31*a*. Each virtual inner end 31*ab* is the point of intersection between an extension line of each lower front end side 31*a* and a virtual line E which is extended forward from each of the left and right ends of the guide pillar 11, namely, each of the end points P of R, in parallel with the left-right intermediate axis Ax of the slider 10. The left and right ends (end points P of R) of the guide pillar 11 are the same for the upper and lower wing plates 20, 30. The virtual inner end 31*ab* of the lower wing plate 30 is in the region of the concave portion 31B. The shoulder opening width W2 of the lower wing plate 30 is also set to be larger than 1 time the left-right width 1 of one element 4*a* and less than or equal to 1.1 times ($1<W2\leq1.1$).

The upper and lower rear ends 22, 32 of the upper and lower wing plates 20, 30 and the upper and lower left and right side ends 23, 33 overlap in the up-down direction. In other words, the upper and lower wing plates 20, 30 have the same contours at the upper and lower rear ends 22, 32 and the upper and lower left and right side ends 23, 33. On the other hand, as can be seen from FIG. 3, the lower front end 31 including the concave side 31*b* of the lower wing plate 30 is slightly displaced backward in the up-down direction (as viewed from the bottom) from the upper front end 21 of the upper wing plate 20. The left and right ends of the lower front end 31 (the outer ends 31*aa* of the lower front end sides 31*a*) and the left and right ends of the upper front end 21 (the outer ends 21*aa* of the upper front end sides 21*a*) substantially coincide with each other in the front-rear direction. The length TL of the slider 10 in the front-rear direction is the length of the upper wing plate 20 in the front-rear direction. The shoulder opening width W1 of the upper wing plate 20 and the shoulder opening width W2 of the lower wing plate 30 are in the range of $1<W1,\ W2\leq1.1$, with respect to the left-right width 1 of the element 4*a*. By setting the shoulder opening widths W1 and W2 of the left and right shoulder openings 41 as described above in the slider 10 of the slide fastener 1, a fabric such as clothes to be drawn into the element path 40 of the slider 10 together with the element rows 4 can be released from the concave portion 31B without unnecessarily expanding the left and right widths of the upper and lower wing plates 20, 30 on the upper and lower front ends 21, 31 side.

With reference to FIG. 7, a depth D of the concave portion 31B of the lower wing plate 30, depressed backward (downward on the paper surface of FIG. 7) from the left and right lower front end sides 31*a* is less than or equal to the depth of each end point P of R (see FIG. 6) of the guide pillar 11, and is set to be 20% or less of the length TL (see FIG. 3, etc.) of the slider 10 in the front-rear direction. In the present embodiment, the depth D of the concave portion 31B is about 7% of the length TL of the slider 10. By setting the depth D of the concave portion 31B to be 20.0% or less of the length TL of the slider 10, it is possible to minimize the damage caused by the concave portion 31B to a fabric released from the concave portion 31B. Further, the front end of the guide pillar 11 is located backward the left and right lower front end sides 31*a* and the concave side 31*b* (concave portion 31B). This can lead to easily release a fabric from the concave portion 31B before the fabric that may be bitten enters the space between the element row 4 and the guide pillar 11.

The upper wing plate 20 includes left and right upper flanges 24 protruding downward from the left and right side ends on the lower surface of the upper wing plate 20. Each upper flange 24 extends over the entire length of the upper wing plate 20 in the front-rear direction in the present embodiment. The upper flanges 24 define the upper left and right side ends 23 of the slider 10. Further, the front ends of the upper flanges 24 define the left and right outer ends of the open ends of the shoulder openings 41. The rear ends of the upper flanges 24 define the left and right side ends of the rear opening 42. The reference numeral 24R in FIG. 6 shows a line in which an R portion on the upper end side of the upper flange 24 reaches the lower surface of the upper wing plate 20. Each of the left and right upper flanges 24 has an inward surface 25 that defines each of the left and right outer sides of the element path 40. The guide pillar 11 defines the left and right inner sides of the branched portions 40A of the element path 40. Each upper flange 24 is divided into an upper branched flange portion 24A corresponding to the branched portion 40A of the element path 40 and an upper confluent flange portion 24B corresponding to the confluent portion 40B. The distance between the left and right upper branched flange portions 24A gradually narrows toward the rear confluent portion 40B. The left and right upper confluent flange portions 24B are parallel to each other. Further, the inward surface 25 of each upper branched flange portion 24A is divided into a front first inward surface 26 and a second inward surface 27 extending backward from the first inward surface 26 and angled with respect to the first inward surface 26. The two-dot chain line 26L in FIG. 6 is an extension line of the first inward surface 26, and the two-dot chain line 27L is an extension line of the second inward surface 27. The first inward surface 26 substantially intersects with each of the outer ends 21*aa* of the left and right upper front end sides 21*a*. The angle θ1 formed by the first inward surface 26 and the left and right upper front end sides 21*a* is an obtuse angle. In this embodiment, the angle θ1 is approximately 91° to 93°. Further, the angle formed by the two-dot chain line 27L and the left-right intermediate axis Ax is slightly larger than the angle formed by the two-dot chain line 26L and the left-right intermediate axis Ax of the slider 10. As a result, a ratio where the distance between the left and right upper branched flange portions 24A narrows backward is higher in the second inward surfaces 27 than in the first inward surfaces 26. In other words, it can also be said that the branched portions 40A extend from the rear opening 42 side to the front shoulder openings 41 such that the outer sides of the branched portions 40A bend from the second inward surface 27 to the first inward surface 26.

The lower wing plate 30 includes left and right lower flanges 34 protruding upward from the left and right side ends on the upper surface of the lower wing plate 30. As can be seen from FIG. 5, etc., each lower flange 34 has a lower height than that of each upper flange 24. Each lower flange 34 is substantially the same as each upper flange 24, with the exception that the height is lower. Each lower flange 34 extends over the entire length of the lower wing plate 30 in the front-rear direction. The lower flanges 34 have inward surfaces 35 that define the left and right outer sides of the element path 40 together with the inward surfaces 25 of the upper flanges 24. Each lower flange 34 is divided into a lower branched flange portion 34A corresponding to the branched portion 40A of the element path 40 and a lower confluent flange portion 34B corresponding to the confluent portion 40B. The inward surface 35 of the lower branched flange portion 34A is divided into a front first inward surface 36 and a second inward surface 37 extending backward from the first inward surface 36 and angled with respect to the first inward surface 36. The two-dot chain line 36L in FIG. 7 is an extension line of the first inward surface 36, and the two-dot chain line 37L is an extension line of the second inward surface 37. The first inward surface 36 substantially intersects with each of the outer ends 31*aa* of the left and right lower front end sides 31*a*. The angle θ2 formed by the first inward surface 36 and the left and right lower front end sides 31*a* is an obtuse angle. In this embodiment, the angle θ2 is slightly larger than the angle θ1. The angle formed by the two-dot chain line 37L and the left-right intermediate axis Ax is slightly larger than the angle formed by the two-dot chain line 36L and the left-right intermediate axis Ax of the slider 10, and a ratio where the distance between the left and right lower branched flange portions 34A narrows backward is higher in the second inward surfaces 37 than in the first inward surfaces 36.

The first inward surfaces 26, 36 of the upper and lower branched flange portions 24A, 34A of the upper and lower wing plates 20, 30 determine an inclination of the longitudinal axis Ex (see FIG. 1) of each of the left and right element rows 4 immediately before entering the left and right shoulder openings 41 with respect to the left-right intermediate axis Ax of the slider 10. In other words, the longitudinal axis Ex each of the element rows 4 immediately before entering the left and right shoulder openings 41 is substantially parallel to the corresponding first inward surfaces 26, 36. Further, since the angles θ1 and θ2 formed by the first inward surfaces 26, 36 and the left and right upper and lower front end sides 21*a*, 31*a* are obtuse angles as described above, the angles formed by the longitudinal axes Ex of the element rows 4 immediately before entering the left and right shoulder openings 41 and the left and right upper and lower front end sides 21*a*, 31*a* are also obtuse angles, which are substantially the same as the angles θ1 and θ2. This can reduce the element rows 4 from pulling a fabric into the shoulder openings 41. On the other hand, in the conventional slider in which the front end on the shoulder opening side protrudes forward in an inverted U-shape or an inverted V-shape, the open end sides of the shoulder openings have an acute angle with respect to the longitudinal axes Ex, so that a fabric was easy to be bitten by the element rows.

Further, as described above, in the upper and lower wing plates 20, 30, the ratio where the distance, along the left-right direction, between the left and right upper and lower branched flange portions 24A, 34A gradually narrows toward the rear confluent portion 40B is higher in the second inward surfaces 27, 37 than in the first inward surfaces 26, 36. Therefore, when the element rows 4 of the left and right fastener stringers 2 are engaged with each other, the element rows 4 can be more aligned from the first inward surfaces 26, 36 to the second inward surfaces 27, 37, so that the element rows 4 can be more smoothly engaged.

With reference to FIGS. 4 and 5, a gap G is set between each upper flange 24 of the upper wing plate 20 and each lower flange 34 of the lower wing plate 30. The fastener tapes 3 extending to the left and right from the element rows 4 in the element path 40 of the slider 10 is exposed to the outside of the slider 10 through the gap G. Conventionally, during the movement of the slider 10, the fastener tapes 3 may be drawn into the element path 40 through the gap G. In order to prevent this, the slide fastener 1 is provided with thick portions 7 near the element rows 4 in the left and right fastener tapes 3. FIG. 8 is a cross-sectional view taken along the line F-F in FIG. 1. Each thick portion 7 is a portion that is partially thickened during weaving each fastener tape 3 and, in the present embodiment, is continuously formed along the longitudinal direction of the fastener tape 3 It should be noted that each thick portion 7 may be formed intermittently along the longitudinal direction of the fastener tape 3. Further, each thick portion 7 can be subsequently attached to the fastener tape 3 such as by injection molding of a resin. Each thick portion 7 protrudes from the front and back surfaces of the fastener tape 3 with the same height, but the protruding height may be different from each other. The height H of the thick portion 7 along the up-down direction (height of the thick portion 7 on the front surface side of the fastener tape 3+height of the thick portion on the back surface side of the fastener tape 3+thickness of the fastener tape 3) is set to be higher than the gap G between each upper flange 24 of the upper wing plate 20 and each lower flange 34 of the lower wing plate 30. In FIG. 8, each thick portion 7 is shown by a rectangular cross section for convenience, but any shape may be used as long as the height H of the thick portion 7 is higher than the gap G, for example, the cross section may be elliptical, oval or the like. The height H of each thick portion 7 higher than the gap G can restrict the entry of the fastener tape 3 into the element path (40) even if the fastener tape 3 is to be drawn into the element path 40 of the slider 10 through the gap G during the movement of the slider 10.

FIG. 9 is a partial cross-sectional plane view, similar to FIG. 7, showing a second embodiment of the lower wing plate. A main difference between the lower wing plate 30A of FIG. 9 and the lower wing plate 30 of the first embodiment is that the former is provided with a concave portion 31C recessed backward on each of the left and right lower front end sides 31*a*. Therefore, same reference numerals are given to the configuration substantially common to the lower wing plate 30, and descriptions thereof will be omitted. The slider (10) using the lower wing plate 30A is a slider according to the second embodiment, which is applicable to the slide fastener 1 according to the present invention. The lower front end 31 of the lower wing plate 30A includes left and right lower front end sides 31*a*. The shoulder opening width W2 in a direction along the left and right lower front end sides 31*a* is the length between an outer end 31*aa* of each lower front end side 31*a* and an inner end 31*ac* of each lower front end side 31*a* in the left-right direction. The shoulder opening width W2 is set to be larger than 1 time the left-right width 1 of the element 4*a* and less than or equal to 1.1 times ($1<W2\leq1.1$). Each inner end 31*ac* is on a virtual line E that is extended forward from each of the left and right ends of the guide pillar 11 in parallel with the left-right intermediate axis Ax of the slider 10. Each concave portion 31C is formed to be recessed backward from each of the left and right lower front end sides 31*a* in a semicircular shape. The depth D of each concave portion 31C is set to be less than or equal to each end point P (see FIG. 6) of R of the guide pillar 11, and to be 20% or less of the length TL in the front-rear direction of the slider 10. The two left and right concave portions 31C also allow a fabric that may be bitten to be released. Further, also in the lower wing plate 30A, the front end of the guide pillar 11 is located backward the left and right lower front end sides 31*a* and the concave portions 31C. This can help a fabric to be easily released from the concave portions 31C before the fabric that may be bitten enters the space between the element row 4 and the guide pillar 11.

FIG. 10 is a perspective view showing a slider 110 according to a third embodiment. FIG. 11 is a bottom view of the slider 110. FIG. 12 is a side view of the slider 110. The slider 110 can be applied to the slide fastener 1 in place of the slider 10 of the first and second embodiments described above. The slider 110 comprises an upper wing plate 120, a lower wing plate 130, and a guide pillar 111 connecting between the upper wing plate 120 and the lower wing plate 130. Main differences of the slider 110 from the slider 10 according to the first embodiment described above are an upper front end 121 of the upper wing plate 120; a lower front end 131 of the lower wing plate 130; and a guide pillar 111, especially a front end portion 111*a* and a horizontal cross-sectional shape of the guide pillar 111. Therefore, regarding configurations other than these differences, detailed descriptions thereof will be omitted by using same reference numerals as those of the slider 10 according to the first embodiment.

With reference to FIG. 11, the upper front end 121 of the upper wing plate 120 protrudes slightly forward from the left and right outer ends 121*a* to the left-right intermediate point 121*b*. The upper front end 121 includes left and right front end sides forming open ends of the left and right shoulder openings 41. FIG. 13 is a partial cross-sectional plane view, similar to FIG. 7, showing an upper surface of the lower wing plate 130. The lower front end 131 of the lower wing plate 130 is divided into left and right lower front end sides 131*a* forming a part of the open ends of the left and right shoulder openings 41 and a concave side 131*b* recessed backward between the left and right lower front end sides 131*a*. The left and right lower front end sides 131*a* are substantially perpendicular to the slider left-right intermediate axis Ax. The concave side 131*b* defines a concave portion 131B that is recessed backward from the left and right lower front end sides 131*a* between the left and right lower front end sides 131*a*. With reference to FIG. 12, etc., the front end portion 111*a* of the guide pillar 111 is inclined so as to gradually protrude forward from the lower side to the upper side. The reference numeral α in FIG. 12 represents an angle at which the front end portion 111*a* of the guide pillar 111 is inclined with respect to the horizontal. The upper end 111*aa* at the front end 111*a* of the guide pillar 111 connects to the intermediate point 121*b* or its vicinity of the upper front end 121 of the upper wing plate 120. The lower end 111*ab* at the front end 111*a* of the guide pillar 111 connects to the intermediate point 131*ba*, in the left-right direction, or its vicinity of the concave side 131*b* of the lower wing plate 130. The intermediate point 131*ba* of the concave side 131*b* defines a depth Dx of the concave side 131B from the left and right lower front end sides 131*a* toward the rear. When the position of the front end portion 111*a* of the guide pillar 111 with respect to the upper wing plate 120 of the upper end 111*a* is fixed, the intermediate point 13*ba* of the concave side 131*b* moves more toward the rear side as the depth Dx of the concave portion 131B becomes deeper. According to this, the lower end 111*ab* of the front end portion 111*a* of the guide pillar 111 has to be displaced toward the rear so as to reduce the inclination angle α of the front end portion 111*a* of the guide pillar 111. On the other hand, the intermediate point 131*ba* of the concave side 131*b* can be set forward as the depth Dx of the concave portion 131B is shallower, and accordingly, the lower end 111*ab* of the front end portion 111*a* of the guide pillar 111 can be displaced forward so as to increase the inclination angle α of the front end portion 111*a* of the guide pillar 111. With reference to FIG. 11, the front end portion 111*a* of the guide pillar 111 is exposed from the concave portion 131B of the lower wing plate 130 as viewed from the bottom. The length TL of the slider 110 in the front-rear direction is the length of the upper wing plate 120 in the front-rear direction.

The reference numerals P1 in FIGS. 12 and 13 are the end points of the left and right R of the guide pillar 111. That is, in the horizontal cross section of the guide pillar 111 as shown in FIG. 13, the left and right R, which are formed so as to gradually expand the left and right width therebetween from the rear end O1 toward the front, terminate at the end points P1 of R. The end points P1 of the guide pillar 111 are substantially constant even if the inclination angle α of the front end portion 111*a* of the guide pillar 111 varies by changing the depth Dx of the concave portion 131B. Further, the end points P1 of R are at the same position, as viewed in a horizontal plane, in the height (up-down) direction of the guide pillar 111. In the slider 110, the end points P1 of R coincide with the left and right ends of the guide pillar 111.

Further, in the slider 110, the depth Dx of the concave portion 131B is a depth that does not reach the end points P1 of R of the guide pillar 111, and is set to be 20.0% or less of the length TL of the slider 110 in the front-rear direction.

Experimental Example 1

Biting performance was measured as follows using the slide fasteners (1) to which the sliders (110) having different depths Dx of the concave portions 131B of the lower wing plates 130 were applied. Although the following Comparative Examples 1 and 2 (samples S1 and S6) are out of the range of the slide fastener 1 and its slider 110 according to the present invention, Comparative Examples 1 and 2 will also be described using the reference numerals for the slide fastener 1 and the slider 110 for convenience (this point is the same for Experimental Example 2 as described below).

Samples S1 to S6 of sliders 110 having a length TL of 14.0 mm in the front-rear direction and different depths Dx were prepared:

Sample S1 (Comparative Example 1): Depth Dx=0 mm;

Sample S2 (Example 1): Depth Dx=0.5 mm;

Sample S3 (Example 2): Depth Dx=1.0 mm;

Sample S4 (Example 3): Depth Dx=1.5 mm;

Sample S5 (Example 4): Depth Dx=2.8 mm; and

Sample S6 (Comparative Example 2): Depth Dx=2.9 mm.

The depths Dx of the samples S1 to S6 are 0%, 3.6%, 7.1%, 10.7%, 20.0%, and 20.7% with respect to the length TL of the sliders 110 in the front-rear direction, respectively.

In the slider 110, each end point P1 of R of the guide pillar 111 is at a distance of 2.8 mm backward from each of the left and right lower front end sides 131*a* of the lower wing plate 130. In the Example 4 where the depth Dx is 2.8 mm, the inclination angle α of the front end portion 111*a* of the guide pillar 111 is lower than the angle α as shown in FIG. 12, and the lower end 111*ab* of the front end portion 111*a* is substantially connected to each end point P1 of R. Further, in Comparative Example 2 where the depth Dx is 2.9 mm, the inclination angle α of the front end portion 111*a* of the guide pillar 111 is also lower than the angle α shown in FIG. 12, and the lower end 111*ab* of the front end portion 111*a* slightly goes beyond each end point P1 of R backward.

First, a garment having a thickness of 50 μm, which was relatively easily bitten, was prepared, and then the slide fasteners 1 to which the sliders 110 of the samples S1 to S6 were applied, respectively, were placed on the garment. As can be seen from FIGS. 1 and 8, the slide fastener 1 used in Experimental Example 1 is a coil fastener in which coiled element rows 4 are attached to the front side (upper surfaces of the fastener tapes 3 in FIG. 8) of the front and back surfaces of the fastener tapes 3. An experiment was conducted with this coil fastener as an obverse use. In the obverse use, the upper wing plate 120 of the slider 110 and the pull 50 are arranged on the front surface side of each fastener tape 3. The garment was then pulled out upward so as to have a height of 50 mm from the front space between the element rows 4, 4 of the left and right fastener stringers 2, 2 in the open state of the slide fastener 1. The slider 10 was then slid for a distance of 150 mm in a direction to close the space between the left and right fastener stringers 2, 2 so that the slider 110 abutted against the pulled-out garment. This operation was repeated 10 times, and the number of biting occurred was measured. The results are shown in Table 1.

TABLE 1

| | Depth Dx | Dx/TL | Number of Biting Occurred |
|---|---|---|---|
| Sample S1 (Comparative Example 1) | 0 mm | 0.0% | 10 times |
| Sample S2 (Example 1) | 0.5 mm | 3.6% | 3 times |
| Sample S3 (Example 2) | 1.0 mm | 7.1% | 0 times |
| Sample S4 (Example 3) | 1.5 mm | 10.7% | 1 times |
| Sample S5 (Example 4) | 2.8 mm | 20.0% | 5 times |
| Sample S6 (Comparative Example 2) | 2.9 mm | 20.7% | 10 times |

As can be seen from Table 1, the number of biting occurred was 10 times for sample S1 (Comparative Example 1), 3 times for sample S2 (Example 1), 0 times for sample S3 (Example 2), and 1 time for sample S4 (Example 3), 5 times for sample S5 (Example 4), and 10 times for sample S6 (Comparative Example 2). It was found that when the depth Dx of the concave portion 131B was longer backward beyond the end points P1 of R as in Comparative Example 2, the garment tended to be introduced into between the slider 110 and the guide pillar 111 (a place where biting was most likely to occur), and the biting occurred with almost 100% probability. Further, it was found that when the depth Dx of the concave portion 131B was zero, i.e., when the concave portion 131B did not exist as in Comparative Example 1, the garment could not be released, and in this case as well, the biting occurred with almost 100% probability. On the other hand, in Examples 1 to 4, the number of biting occurred was reduced. Therefore, the experimental results revealed that it is preferable that the depth Dx of the concave portion 131B is larger than zero and is less than or equal to each end point P1 of R, and also that the depth Dx is larger than 0% and is less than or equal to 20.0% of the length TL of the slider 110 in the front-rear direction. By setting the depth Dx of the concave portion 131B as such, it is possible to minimize the biting that would otherwise occur when the left and right fastener stringers 2, 2 of the slide fastener 1 are closed. Further, in the slider 110, the lower end 111*ab* of the front end portion 111*a* of the guide pillar 111 is located backward from the left and right lower front end sides 131*a* and the concave side 131*b* (concave portion 131B) of the lower wing plate 130. This can allow a fabric (garment) that may be bitten to be easily released from the concave portion 131B before the garment enters the space between the element row 4 and the guide pillar 111. In addition, when the front end portion 111*a* of the guide pillar 111 is slanted as shown in FIG. 12, etc., it is possible to suppress the movement of the garment in the up-down direction and the left-right direction of the slider 110, reducing the biting to occur.

Experimental Example 2

Next, bite performance was measured as follows using the slide fasteners 1 of FIG. 1 as a reverse use, and the slide fasteners 1 in which depths Dx of the concave portions 131B of the lower wing plates 130 were changed. Although not shown, the slide fasteners 1 for the reverse use, which are employed in Experimental Example 2, are a coil fastener in which coil-shaped element rows 4 are attached to the back side of the front and back surfaces of the fastener tapes 3. Even in the reverse use of the slide fastener 1, the upper wing plate 120 and the pull 50 of the slider 110 are arranged on the front side (the side without the element rows 4) of the fastener tapes 3, and the lower wing plate 130 is arranged on the back side of the fastener tapes 3 (the side with the element rows 4). In other words, it can be said that the reverse use of the slide fastener 1 is one where the front and back sides of the left and right fastener stringers 2, 2 are reversed while the slider (110) of the slide fastener 1 in FIG. 1 as it is. It should be noted that the slide fastener 1 for the reverse use will also be described using the same reference numerals as those of the slide fastener 1 for the obverse use.

In Experimental Example 2, samples T1 to T4 of sliders 110 having a length TL of 15.15 mm in the front-rear direction and different depths Dx were prepared:

Sample T1 (Comparative Example 3): Depth Dx=0 mm;
Sample T2 (Example 5): Depth Dx=1.5 mm;
Sample T3 (Example 6): Depth Dx=5.3 mm;
Sample T4 (Comparative Example 4): Depth Dx=5.4 mm;

The depths Dx of the samples T1 to T4 are 0%, 9.9%, 35.0% and 35.6% of the length TL of the sliders 110 in the front-rear direction, respectively.

In the slider 110, the end points P1 of R of the guide pillar 111 are at a distance of 5.3 mm backward from the left and right front end sides 131*a* of the lower wing plate 130. In Example 6 where the depth Dx is 5.3 mm, the inclination angle α of the front end portion 111*a* of the guide pillar 111 is lower than the angle α as shown in FIG. 12, and the lower end 111*ab* of the front end portion 111*a* substantially connects to the end points P1 of R. Further, in Comparative Example 4 where the depth Dx is 5.4 mm, the inclination angle α of the front end portion 111*a* of the guide pillar 111 is lower than the angle α as shown in FIG. 12, and the lower end 111*ab* of the front end portion 111*a* slightly goes beyond each end point P1 of R backward.

On a garment having the same thickness of 50 μm as in Experimental Example 1, the slide fasteners 1 for the reverse use to which the sliders 110 of the samples T1 to T6 were applied, respectively, were placed. That is, the slide fasteners 1 were placed on the garment so that the back side of the fastener tapes 3 having the element rows 4 faced the garment. Subsequently, as in Experimental Example 1, the garment was pulled out so as to have a height of 50 mm from the space between the element rows 4, 4 of the left and right fastener stringers 2, 2 in the open state of the slide fastener 1, and then the slider 10 was slid for a distance of 150 mm in a direction to close the space between the left and right fastener stringers 2, 2 so that the sider 110 abutted against the pulled-out garment. This operation was repeated 10 times, and the number of biting occurred was measured. The results are shown in Table 2.

TABLE 2

| | Depth Dx | Dx/TL | Number of Bitting Occurred |
|---|---|---|---|
| Sample T1 (Comparative Example 3) | 0 mm | 0.0% | 10 times |
| Sample T2 (Example 5) | 1.5 mm | 9.9% | 0 times |
| Sample T3 (Example 6) | 5.3 mm | 35.0% | 5 times |
| Sample T4 (Example 4) | 5.4 mm | 35.6% | 10 times |

As can be seen from Table 2, the number of biting occurred was 10 times for the sample T1 (Comparative Example 3), 0 times for the sample T2 (Example 5), 5 times for the sample T3 (Example 6), and 10 times for the sample T4 (Comparative Example 4). It was found that when the depth Dx of the concave portion 131B is longer backward from the end points P1 of R as in Comparative Example 4, the garment tended to be introduced between the slider 110 and the guide pillar 111 (a place where biting is most likely to occur), and the biting occurred with almost 100% probability. Further, it was found that when the depth Dx of the concave portion 131B was zero, that is, when the concave portion 131B did not exist as in Comparative Example 3, the garment could not be released, and in this case as well, the biting occurred with almost 100% probability. On the other hand, in Examples 5 to 6, the number of biting was reduced. Therefore, the experimental results revealed that it is preferable that the depth Dx of the concave portion 131B is longer than 0 and is less than or equal to the end points P1 of R, and also that the depth Dx is larger than 0% and is less than or equal to 35.0% of the length TL of the slider 110 in the front-rear direction.

In the above descriptions, examples where the concave portions 31B, 31C, 131B are provided in the lower wing plates 30, 30A, 130 have been described, but the concave portions 31B, 31C, 131B may be provided not only in the lower wing plates 30, 30A, 130 but also in the upper wing plate 20, 120.

DESCRIPTION OF REFERENCE NUMERALS

1 slide fastener
2 fastener stringer
3 fastener tape
4 element row
4*a* element
7 thick portion
10, 110 slider
11,110 guide pillar
20, 120 upper wing plate
21*a* upper front end side
21*aa* outer end of upper front end side
21*ab* inner end of upper front end side
24 upper flange
25 inward surface of upper flange
26 upper first inward surface
27 upper second inward surface
30, 30A, 130 lower wing plate
31*a*, 131*a* lower front end side
31*aa* outer edge of lower front end side
31*ab* virtual inner end of lower front end side
31*ac* inner end of lower front end side
31B, 31C, 131B concave portion
34 lower flange
35 inward surface of lower flange
36 lower first inward surface
37 lower second inward surface
40 element path
40A branched portion of element path
40B confluent portion of element path
41 shoulder opening
42 rear opening
P, P1 end point of R
D, Dx depth of concave portion 31B, 31C, 131B
TL length of slider 10, 110 in front-rear direction
Ax left-right intermediate axis of slider
Ex longitudinal axis Ex of element row just before entering shoulder opening
W1, W2 shoulder width
G gap

The invention claimed is:

1. A slide fastener (1), comprising:

a pair of left and right fastener stringers (2) each having an element row (4) at each of opposing edge portions of left and right fastener tapes (3); and a slider (10, 110) being configured to engage the element rows (4) by moving forward between the pair of left and right fastener stringers (2) and to disengage the element rows (4) by moving backward, wherein the slider (10, 110) comprises:

an upper wing plate (20, 120); a lower wing plate (30, 30A, 130);

a guide pillar (11, 111) for connecting the upper wing plate (20, 120) to the lower wing plate (30, 30A, 130);

a Y-shaped element path (40) defined between the upper wing plate (20, 120) and the lower wing plate (30, 30A, 130);

left and right shoulder openings (41) that are open forward the element path (40); and a rear opening (42) that is open backward the element path (40);

wherein each of the upper wing plate (20, 120) and the lower wing plate (30, 30A, 130) has left and right front end sides (21*a*, 31*a*, 131*a*) that form opening ends of the left and right shoulder openings (41);

wherein at least one of the upper wing plate (20, 120) and the lower wing plate (30, 30A, 130) has one or more concave portions (31B, 31C, 131B) recessed backward from the left and right front end sides (21*a*, 31*a*, 131*a*); and wherein a depth (D, Dx) of each of the concave portions (31B, 31C, 131B) recessed backward from the left and right front end sides (21*a*, 31*a*, 131*a*) is larger than zero, and less than or equal to a distance to each of end points (P, P1) of R of the guide pillar (11, 111), wherein at least one of the upper wing plate (20, 120) and the lower wing plate (30, 30A, 130) comprises left and right flanges (24, 34) that define left and right outer side surfaces of the element path (40) as inward surfaces (25, 35), wherein each of the inward surfaces (25, 35) of the left and right flanges (24, 34) comprises a first inward surface (26, 36) that intersects with an outer end (21*aa*, 31*aa*) of each of the left and right front end sides (21*a*, 31*a*, 131*a*), wherein the element path (40) comprises:

branched portions (40A) defined on left and right sides of the guide pillar (11, 111), the branched portions (40A) being open at the left and right shoulder openings (41); and a confluent portion (40B) extending backward from the branched portions (40A) and being open at the rear opening (42), wherein the left and right flanges (24, 34) include branched flange portions (24A) corresponding to the branched portions (40A), wherein each of the branched flange portions (24A) includes the first inward surface (26); and a second inward surface (27) extending backward from the first inward surface (26), the second inward surface (26) being angled with respect to the first inward surface (26), and wherein an inclination angle with respect to a left-right intermediate axis (Ax) of the slider (10) is larger for the second inward surface (27) than for the first inward surface (26).

2. The slide fastener according to claim 1, wherein a front end portion (111*a*) of the guide pillar (111) is inclined so as to gradually project forward from the lower wing plate (130) to the upper wing plate (120).

3. The slide fastener according to claim 1, wherein the depth (D, Dx) of each of the concave portions (31B, 31C, 131B) depressed backward from the left and right lower front end sides (21*a*, 31*a*, 131*a*) is larger than 0% and less than or equal to 20% of a length (TL) of the slider (10, 110) in a front-rear direction.

4. The slide fastener according to claim 1, wherein the slide fastener (1) has coiled element rows (4) on only one of front and back surfaces of the fastener tapes (2), and in reverse use for using the side having the element row (4) as a back surface, the depth (D, Dx) of each of the concave portions (31B, 31C, 131B) recessed backward from the left and right front end sides (21*a*, 31*a*, 131*a*) is larger than 0% and less than or equal to 35.0% of a length (TL) of the slider (10, 110) in a front-rear direction.

5. The slide fastener according to claim 1, wherein one or more of the concave portions (31B,131B) are provided between the left and right front end sides (31*a*, 131*a*).

6. The slide fastener according to claim 1, wherein a shoulder opening width (W1, W2) of each of the left and right shoulder openings (41) in a direction along the left and right front end sides (21*a*, 31*a*, 131*a*) is larger than 1 time and less than or equal to 1.1 times a width of one element (4*a*), along a left-right direction, of the element row (4).

7. The slide fastener according to claim 6, wherein each of the shoulder opening widths (W1, W2) is a distance between an outer end (21*aa*, 31*aa*) of the left and right front end sides (21*a*, 31*a*, 131*a*) and an inner end (21*ab*, 31*ac*) of the left and right front end sides (21*a*, 31*a*, 131*a*), or a distance between the outer end (21*aa*, 31*aa*) of the left and right front end sides (21*a*, 31*a*, 131*a*) and a virtual inner end (31*ab*) of the left and right front end sides (21*a*, 31*a*, 131*a*) in a region of each of the concave portions (31B, 131B), and wherein the inner end (21*ab*, 31*ac*) or the virtual inner end (31*ab*) is on a virtual line (E) in which each of the left and right ends of the guide pillar (11) is extended forward in parallel with the left-right intermediate axis (Ax) of the slider (10).

8. The slide fastener according to claim 1, wherein the first inward surface (26, 36) of each of the left and right flanges (24, 34) and each of the left and right front end sides (21*a*, 31*a*, 131*a*) form an obtuse angle (θ1, θ2).

9. The slide fastener according to claim 1, wherein a front end of the guide pillar (11) is located backward from the left and right front end sides (21*a*, 31*a*) and the concave portions (31B, 31C).

10. The slide fastener according to claim 1, wherein one or more of the concave portions (31C) are provided at each of the left and right front end sides (31*a*).

11. The slide fastener according to claim 1, wherein the slider (10, 110) includes left and right gaps (G) between the upper wing plate (20, 120) and the lower wing plate (30, 30A, 130) for passing the left and right fastener tapes (3) corresponding to the element rows (4) in the element path (40), wherein each of the left and right fastener tapes (3) includes a thick portion (7) along a longitudinal direction, the thick portion (7) restricting entry of the left and right fastener tapes (3) into the element path (40) through the left and right gaps (G), and wherein a length (H) of each of the thick portions (7) in an up-down direction is larger than a distance of each of the gaps (G) in the up-down direction.

* * * * *